United States Patent [19]

Welter

[11] 4,391,404

[45] Jul. 5, 1983

[54] SLEEVE VALVE FOR FLEXIBLE BAGS

[75] Inventor: Albert Welter, Franklin, Ohio

[73] Assignee: Champion International Corporation, Stamford, Conn.

[21] Appl. No.: 292,622

[22] Filed: Aug. 13, 1981

[51] Int. Cl.[3] ..... B65D 30/24

[52] U.S. Cl. ..... 229/62.5

[58] Field of Search ..... 229/62.5, 3.5, 55, DIG. 14; 206/813

[56] References Cited

U.S. PATENT DOCUMENTS

| | | | |
|---|---|---|---|
| 2,891,716 | 6/1959 | Lee | 229/62.5 |
| 3,000,550 | 9/1961 | Cherlton | 229/62.5 |
| 4,095,736 | 6/1978 | Rothschild et al. | 229/62.5 |
| 4,316,574 | 2/1982 | Lepisto | 229/62.5 |

*Primary Examiner*—Steven M. Pollard
*Assistant Examiner*—Bryon Gehman
*Attorney, Agent, or Firm*—Evelyn M. Sommer

[57] ABSTRACT

An improved sleeve valve for use in a flexible paper bag which is adapted to package granular products. The sleeve is mounted in the open mouth located in a corner of the flexible bag and adapted to receive the filler spout of a product-dispensing mechanism. The sleeve valve comprises a tubular plastic sleeve which is adhered to both the open mouth of the bag and to a paper backing panel. The sleeve valve is adhered to the backing panel by three glue bars which are spaced from each other and spaced inwardly from the mouth of the sleeve valve. The rear portion of the paper backing panel is slit lengthwise along its longitudinal center and the rear portion of the plastic sleeve valve adjacent the backing panel is also slit lengthwise along its longitudinal center in substantial juxtaposition with the slit in the paper backing panel.

11 Claims, 6 Drawing Figures

SLEEVE VALVE FOR FLEXIBLE BAGS

BACKGROUND OF THE INVENTION

The present invention is directed to an improved sleeve valve for flexible bags. Such flexible bags are used to package granular materials, such as fertilizers, seeds, etc. and are provided with a bottom wall, a top wall, side walls and end walls. The end walls as well as the bottom and top walls are adapted to be folded along predetermined fold lines so that the bags may be flattened for shipment and storage.

One corner of the top wall is provided with an open mouth which is adapted to receive the filler spout of a product-dispensing machine. Mounted within the open mouth and adapted to receive the filler spout is a sleeve valve. Such sleeve valves usually consist of a flexible tubular plastic sleeve and a backing panel. One side of the tubular plastic sleeve is affixed to the backing panel and the opposite side is affixed to the lower portion of the open mouth. The rear portion of the tubular sleeve is not affixed to either the backing panel or to the mouth of the container so that it hangs loosely within the bag. After the bag is filled, the rear portion of the tubular sleeve is bent back by the contents within the bag so that it seals the mouth to prevent the contents of the bag from sifting out of the bag.

An example of such a flexible bag and sleeve valve is described and shown in U.S. Pat. No. 4,316,574 of George Lepisto, owned by the assignee of the present invention and application.

Heretofore, the tubular sleeves used for such sleeve valves have been solid and uninterrupted throughout their peripheries and the paper backing panel to which such tubular sleeves were attached were likewise uninterrupted. It has been found that such sleeves do not sometimes seal as effectively as they should. Furthermore, in existing bags, the tubular plastic sleeve is adhered to the paper backing panel by a uniform layer of adhesive which increases the cost.

SUMMARY OF THE INVENTION

The present invention overcomes these drawbacks and has for one of its objects the provision of an improved sleeve valve which is adhered to a paper backing panel with less adhesive thereby resulting in a saving of adhesive and in decreased costs.

Another object of the present invention is the provision of an improved sleeve valve in which the backing panel and the tubular sleeve itself are partially slit lengthwise to increase the effectiveness of the seal.

Other and further objects of the invention will be obvious upon an understanding of the illustrative embodiment about to be described, or will be indicated in the appended claims, and various advantages not referred to herein will occur to one skilled in the art upon employment of the invention in practice.

In accordance with the invention, the forward portion of the tubular sleeve of the sleeve valve is adhered to the forward portion of the paper backing panel by a plurality of spaced bands of adhesive near the open mouth of the bag. The rear portion tubular sleeve is not adhered to the rear portion of the backing panel. The rear portion of the backing panel as well as the rear portion of the tubular sleeve facing the backing panel are slit lengthwise in substantial juxtaposition with each other.

BRIEF DESCRIPTION OF THE DRAWINGS

A preferred embodiment of the invention has been chosen for purposes of illustration and description and is shown in the accompanying drawings forming a part of the specification, wherein.

DETAILED DESCRIPTION OF THE INVENTION

Figure 1:
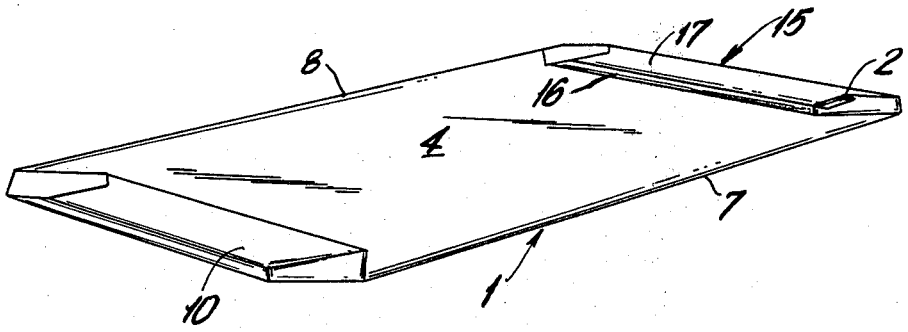
FIG. 1 is a perspective view of a flexible bag made in accordance with the present invention shown in a flattened, collapsed condition.
Figure 6:
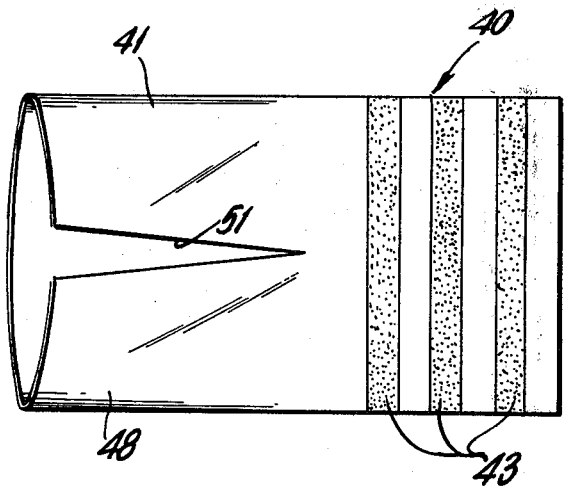
FIG. 6 is a sectional view taken along line 6—6 of FIG. 3.
Figure 3:
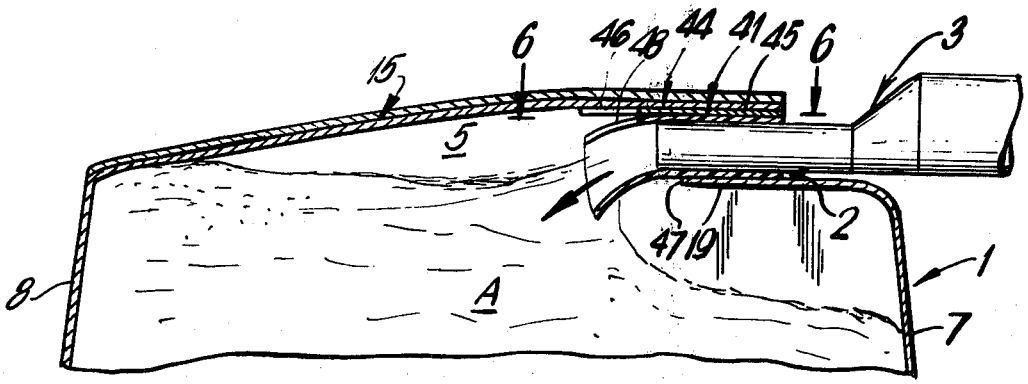
FIG. 3 is a fragmentary sectional view showing the interior of the bag during the filling operation.
Figure 4:
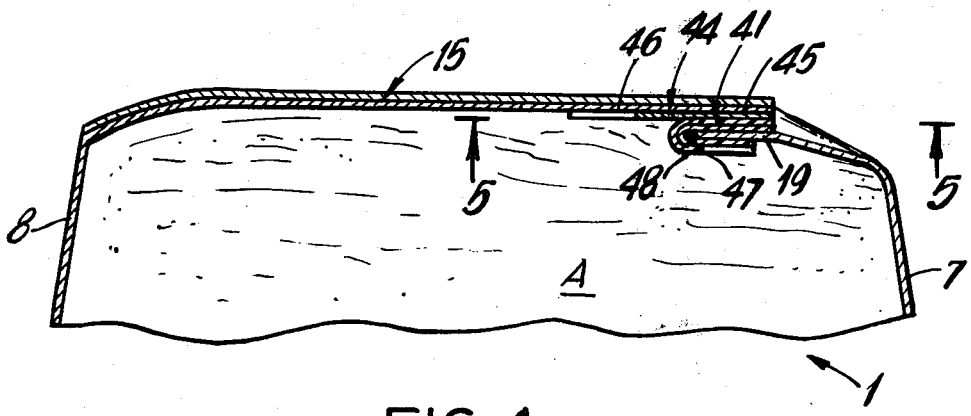
FIG. 4 is a fragmentary sectional view showing the sealed bag after the bag is filled.
Figure 5:
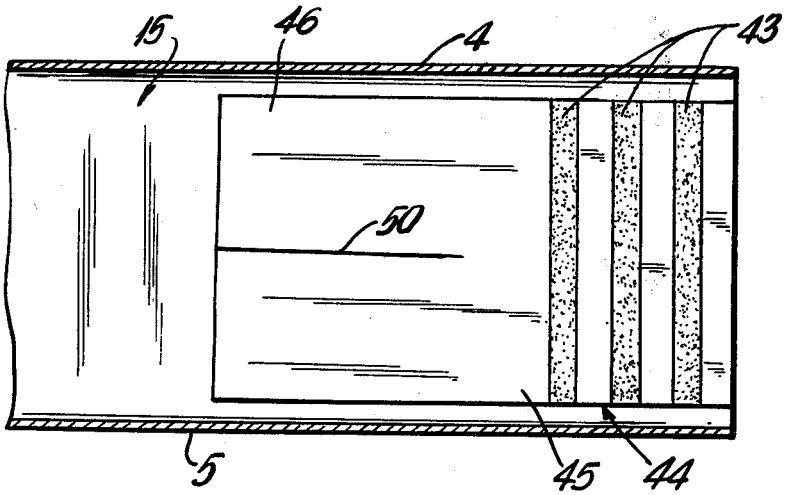
FIG. 5 is a sectional view taken along line 5—5 of FIG. 4.

Referring to the drawings and more particularly to FIGS. 1 and 3, the flexible bag 1 with which the present invention is adapted to be used has an open mouth 2 adapted to receive a dispensing spout 3 of a product-dispensing machine (not shown) which delivers a flowable, fine, powdery, small sized granular product A into the bag 1. The product A may comprise any flowable product, such as grain, fertilizer, cement and the like. The dispensing spout 3 extends into the open mouth 2 of the bag 1 and forms a relatively tight seal therewith to prevent the escape of product into the surrounding atmosphere during the filling operation.

The bag 1 of the present invention may be made of paper, or the like, and may be of single or multiple thickness. Preferably, the bag 1 is of a triple thickness kraft paper and comprises side walls 4 and 5 joined along mutual edges by fold lines 7 and 8 to form a tubular construction. The bottom wall 10 is formed by a plurality of conventional flap members (not shown) hingedly interconnected to the side wall 4 by a fold line (not shown) which permits pivoting of the bottom 10 into an essentially flat condition.

Figure 2:
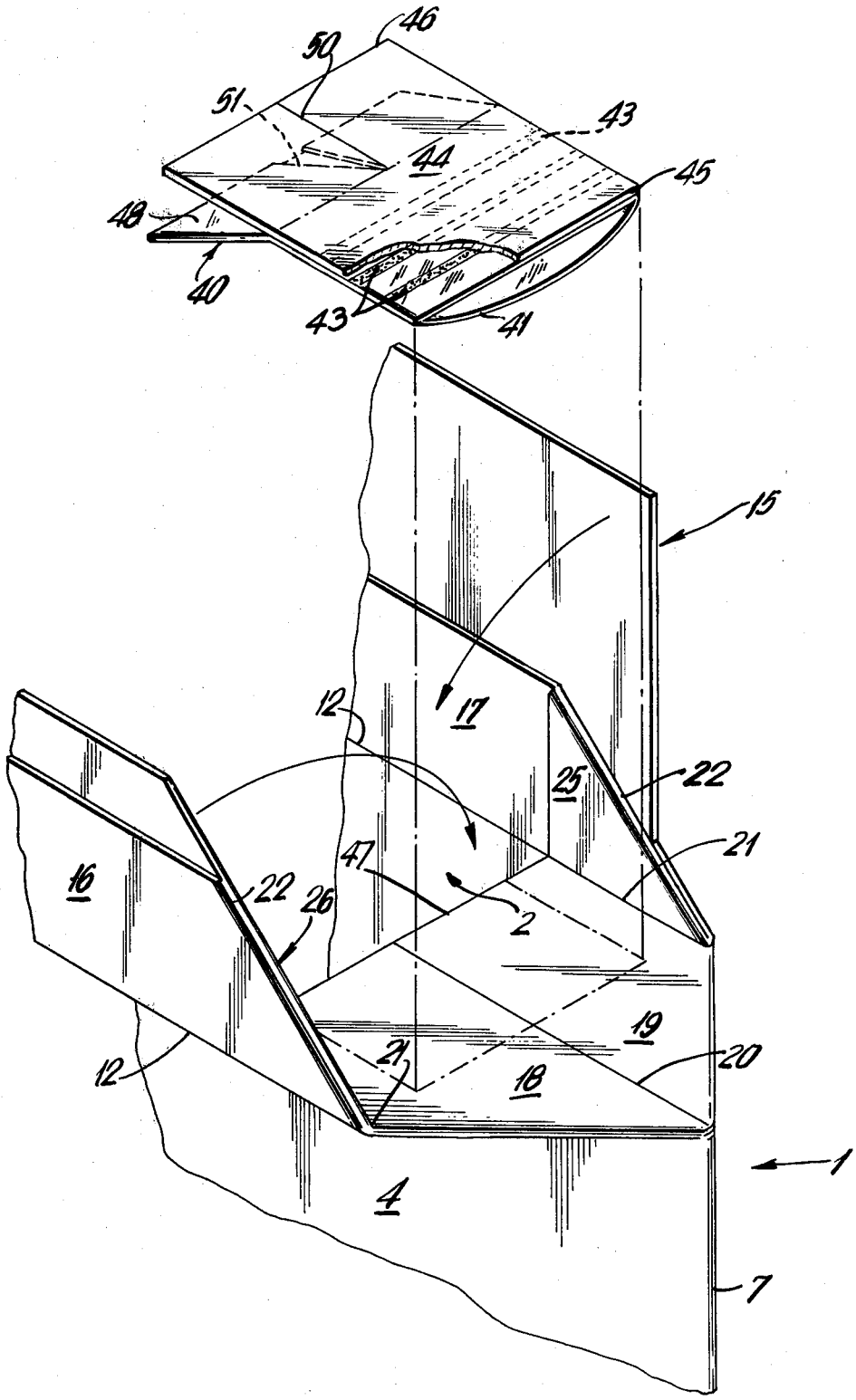
FIG. 2 is a fragmentary exploded view of the corner of the bag in which the open mouth is located and which has the improved sleeve valve positioned therein.

The top wall 15 of the bag 1 is formed by closure flaps 16 and 17 (FIG. 2) connected to side walls 4 and 5 by fold lines 12. End flaps 18 and 19 hingedly connected by a fold line 20 form a juncture with the fold line 7 and are connected to the top flaps 16 and 17 by fold lines 21 and 22, respectively, to form tuck flaps 25 and 26. Closure flap 16 is folded into overlapping relationship to each of the end flaps 18 and 19 and closure flap 17 is folded over closure flap 16 and is secured in overlapping relationship to closure flap 16 and end flaps 18 and 19 by an adhesive. A sleeve valve 40 is mounted within the open mouth 2 and comprises a tubular, plastic sleeve 41 formed from sheet polyethylene plastic preferably having a thickness of 1.5 mil and being of the high density type, most preferably a so-called tubular high density polyethylene. One side (the upper side) of the tubular sleeve 41 is adhered to the inner face of a rectangularly shaped backing panel 44 by a plurality of spaced glue bars 43 and is essentially longitudinally coextensive with the latter. The spaced glue bars 43 used in connection with the preferred form of the invention comprises a starch type adhesive. The glue bars 43 extend between two and three inches inwardly from the open mouth 2 of the bag and are preferably about one-half inch wide and spaced from each other about one-half inch. The use of these spaced glue bars will result in a saving in adhesive and in reduced costs.

The front portion of the opposite side (the bottom side) of plastic sleeve 41 is secured by an adhesive to the outer face of end flaps 18 and 19. The opposite lateral sides of both the tubular sleeve 41 and backing panel 44 are spaced inwardly from the adjacent side edges of end flaps 18 and 19 defined by the fold lines 21. The closure flaps 16 and 17 are adhesively secured to the upper face of backing panel 44 as well as to the upper face of the inner flaps 18 and 19 between fold lines 21 and the lateral edges of backing panel 44.

The front portion 45 of the backing panel 44 extends outwardly beyond the outer edges of the closure flaps 16 and 17, while the rear portion 46 thereof extends inwardly beyond the inner edge 47 of end flaps 18 and 19. The rear portion 48 of tubular sleeve 41 likewise extends inwardly beyond the inner edge 47 of end flaps 18 and 19 and is centrally disposed in suspended relationship within the bag 1. Preferably, the rear portions 46 and 48 of the backing panel 44 and tubular sleeve 41, respectively, extend beyond the rear edge 47 of end flaps 18 and 19 for about four inches. The rear portion 46 of the backing panel 44 is slit lengthwise as at 50 and the rear portion 48 of the tubular plastic sleeve 41 is also slit lengthwise as at 51 in juxtaposed relationship with the slit 50 in the backing panel 44. The slits 50 and 51 are preferably about four inches in length.

With this structure, when the dispensing spout 3 is inserted in the sleeve valve 40 in the mouth 2 in the corner of the bag 1, the slit 51 in the tubular sleeve 41 will allow the sleeve 40 to widen somewhat so that the product A will flow freely into the bag 1 and the bag will be filled quickly.

After being filled to the desired level, the bag 1 is drawn away from the dispensing spout 3 and is tilted in order to shift product A toward the corner of the bag 1 in which the sleeve valve 40 is located. The free rear portion 48 of the plastic sleeve 41 is forced by the shifting product A to fold 90° onto itself and into underlapping relationship to the interior face of end flaps 18 and 19 to seal the sleeve valve 40. The slit 51 will allow the free rear portion 48 of the plastic sleeve 41 to cover a somewhat wider portion of the sleeve valve to effectively seal the sleeve valve 40 to prevent escape of product A therethrough.

It will thus be seen that the present invention provides an improved sleeve valve which will accomplish a saving in adhesive, reduce costs and permit a more effective seal.

The embodiments of the invention in which an exclusive property or privilege is claimed are defined as follows:

1. A flexible bag comprising side walls, a top wall and a bottom wall, an open mouth in the corner of said top wall comprising an end flap, a sleeve valve mounted in said open mouth, said sleeve valve comprising a tubular sleeve and a backing panel, the upper front portion of the tubular sleeve being adhered to the backing panel by an adhesive area and the lower front portion of the sleeve adhered to the end flap of said open mouth of the bag, the upper and lower rear portions of said sleeve being unattached to the backing panel and to said end flap and being adapted to hang within the bag, and a longitudinal slit located exclusively in the upper rear portion of said sleeve, said slit terminating short of said adhesive area to form an unslit area of said upper rear portion unadhered to said backing panel whereby the said unslit area together with the lower rear portion of said sleeve folds over the open mouth to seal the open mouth in the two-ply region of the sleeve.

2. A flexible bag as claimed in claim 1 wherein the rear portion of said backing panel is slit longitudinally in juxtaposition to the slit in said sleeve.

3. A flexible bag as claimed in claim 2 wherein said open mouth is formed by closure flaps which are interposed over each other and by a pair of end flaps underlying the superimposed closure flaps, and said sleeve valve being interposed therebetween.

4. A flexible bag as claimed in claim 3 wherein the backing panel is adhered to the superimposed closure flaps and wherein the lower rear portion of the tubular sleeve is adhered to the end flaps.

5. A flexible bag as claimed in claim 4 wherein said slit is about four inches in length.

6. A flexible bag as claimed in claim 5 wherein said tubular sleeve is adhered to said backing panel by a plurality of spaced glue bars.

7. A flexible bag as claimed in claim 6 wherein said glue bars extend inwardly from the said open mouth of the bag for a distance of between one and two inches.

8. A flexible bag as claimed in claim 7 wherein the said glue bars are about one-half inch in width and are spaced from each other by about one-half inch.

9. A flexible bag as claimed in claim 8 wherein three glue bars are provided.

10. A flexible bag as claimed in claim 9 wherein said backing panel is a paper backing panel and wherein said tubular sleeve is of a flexible plastic material.

11. A flexible bag as claimed in claim 10 wherein the said flexible bag is of a paper material.

* * * * *